US006623157B1

(12) United States Patent
Fujisawa et al.

(10) Patent No.: US 6,623,157 B1
(45) Date of Patent: Sep. 23, 2003

(54) ELECTRONIC TIMEPIECE AND METHOD FOR TRANSMITTING DATA FOR ELECTRONIC TIMEPIECE

(75) Inventors: Teruhiko Fujisawa, Shiojiri (JP); Takashi Kawaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/701,729

(22) PCT Filed: Mar. 30, 2000

(86) PCT No.: PCT/JP00/02032

§ 371 (c)(1),
(2), (4) Date: Nov. 30, 2000

(87) PCT Pub. No.: WO00/58792

PCT Pub. Date: Oct. 5, 2000

(30) Foreign Application Priority Data

Mar. 30, 1999 (JP) ..... 11-089909

(51) Int. Cl.[7] ..... G04C 13/00; G04C 9/00
(52) U.S. Cl. ..... 368/187; 47/201
(58) Field of Search ..... 368/1, 47, 52, 368/200–203

(56) References Cited

U.S. PATENT DOCUMENTS

| | | | | |
|---|---|---|---|---|
| 4,051,663 | A * | 10/1977 | Chihara et al. | 368/200 |
| 6,459,657 | B1 * | 10/2002 | Takada et al. | 368/47 |
| 6,522,601 | B2 * | 2/2003 | Sakayama | 368/47 |
| 6,542,438 | B2 * | 4/2003 | Higuchi et al. | 368/47 |
| 2002/0141290 | A1 * | 10/2002 | Sakuyama | 368/187 |

FOREIGN PATENT DOCUMENTS

| | | | |
|---|---|---|---|
| CN | 87 1 04335 A | | 12/1987 |
| EP | 0 319 297 A2 | | 12/1988 |
| EP | 0 635 771 A1 | | 12/1993 |
| EP | 0 949 548 A1 | | 6/1998 |
| JP | 54 89672 | * | 7/1979 |
| JP | 1-153993 | * | 6/1989 |
| WO | WO98/55902 | | 12/1998 |

* cited by examiner

*Primary Examiner*—David Martin
*Assistant Examiner*—Jeanne-Marguerite Goodwin

(57) ABSTRACT

In an analog electronic timepiece, when a detection circuit detects an external calling signal, a data storage circuit and a data-transmission-signal pulse generating circuit are used to achieve data transmission through a motor coil and a driving circuit, both of which are conventional elements constituting the analog electronic timepiece, at timing between pulses of a driving signal for moving hands.

11 Claims, 7 Drawing Sheets

ELECTRONIC TIMEPIECE AND METHOD FOR TRANSMITTING DATA FOR ELECTRONIC TIMEPIECE

TECHNICAL FIELD

The present invention relates to electronic timepieces and data transmission methods for electronic timepieces, suited, for example, to timepiece apparatuses such as analog timepieces.

BACKGROUND ART

As electronic timepieces, analog electronic timepieces for moving hands by applying a driving signal to a driving motor coil (driving coil) have been conventionally widely known. In these analog timepieces, a driving motor coil used for hand movement also serves as a data receiving coil, and a standard-time signal sent from an external standard-time generating apparatus is received through the driving motor coil to adjust accuracy in a timepiece unit (disclosed, for example, in Japanese Examined Utility Model Publication No. Sho-58-7190).

In some analog timepieces, a driving motor coil also serves as a data transmitting coil (disclosed, for example, in Japanese Unexamined Patent Application Publication No. Hei-6-258464). In the analog timepieces, hand movement is stopped while data is transmitted, and the hands are moved quickly to correct the time after data transmission.

In timepieces which transmit data to the outside among those using the conventional technologies, hand movement is stopped and a driving motor coil is used as a transmission coil while data is transmitted. Therefore, the timepieces need to determine whether data is being transmitted and need to have a time recovery circuit for storing the number of generated pulses of a driving signal during a transmission mode. Therefore, the structures of the timepieces become complicated.

The present invention has been made in consideration of the above condition. Accordingly, an object of the present invention is to provide an electronic timepiece and a data transmission method for an electronic timepiece which allow data to be transmitted with a simple circuit structure.

SUMMARY OF THE INVENTION

A first mode of the present invention is characterized by comprising an oscillation circuit for generating a reference oscillating signal; a dividing circuit for dividing the reference oscillating signal generated by the oscillation circuit and for outputting a divided oscillating signal; a driving-signal generating circuit for generating a driving pulse signal according to the divided oscillating signal output from the dividing circuit; a driving coil for driving a unit to be driven, by the driving pulse signal output from the driving-signal generating circuit; a data storage unit for storing data to be transmitted; and a transmission unit comprising a data-transmission-signal pulse generating circuit for generating a data transmission signal according to the divided oscillating signal output from the dividing circuit and the data stored in the data storage means, for transmitting the data transmission signal to an external data transmitting and receiving apparatus through the driving coil.

A second mode of the present invention is characterized in that, in the first mode of the present invention, the driving-signal generating circuit comprises a first switching element connected between one end of the driving coil and a first power line, a second switching element connected between the other end of the driving coil and the first power line, a third switching element connected between the one end of the driving coil and a second power line, and a fourth switching element connected between the other end of the driving coil and the second power line, and the first switching element and the fourth switching element are turned on at the same time, or the second switching element and the third switching element are turned on at the same time, to make a current flow to transmit the data transmission signal.

A third mode of the present invention is characterized in that, in the first mode or the second mode of the present invention, the transmission unit transmits the data transmission signal to the external data transmitting and receiving apparatus through the driving coil between pulses of the driving pulse signal generated by the driving-signal generating circuit at an almost constant interval.

A fourth mode of the present invention is characterized in that, in the third mode of the present invention, the data transmission signal is synchronized with the driving pulse signal, and is transmitted to the external data transmitting and receiving apparatus at a predetermined timing after the driving pulse signal is output.

A fifth mode of the present invention is characterized, in the first mode or the second mode of the present invention, by further comprising an operation input unit with which the user inputs an instruction, and characterized in that the transmission unit transmits data to the external data transmitting and receiving apparatus when a predetermined instruction is input through the operation input unit.

A sixth mode of the present invention is characterized in that, in the fifth mode of the present invention, the transmission unit switches the mode to a data transmission mode and transmits data to the external data transmitting and receiving apparatus when the predetermined instruction is input through the operation input unit, and the transmission unit releases the data transmission mode to stop the data transmission when a predetermined instruction corresponding to stopping the data transmission is input through the operation input unit during the data transmission mode.

A seventh mode of the present invention is characterized, in the first mode of the present invention, by further comprising a calling-signal detecting unit for detecting a calling signal output from the external data transmitting and receiving apparatus, through the driving coil, and characterized in that the transmission unit transmits data to the external data transmitting and receiving apparatus when the calling-signal detecting unit detects the calling signal.

An eighth mode of the present invention is characterized in that, in the first mode of the present invention, the unit to be driven is an analog timepiece unit which achieves a timepiece operation by using analog hands.

A ninth mode of the present invention is characterized in that, in the first mode of the present invention, the data stored in the data storage unit is operation information data of the electronic timepiece.

A tenth mode of the present invention is characterized in that, in the first mode of the present invention, the data stored in the data storage unit is either identification data unique to the unit to be driven or individual data of the user.

In an eleventh mode of the present invention, a data transmission method for an electronic timepiece having an oscillation circuit for generating a reference oscillating signal; a dividing circuit for dividing the reference oscillating signal generated by the oscillation circuit and for outputting a divided oscillating signal; a driving-signal generating circuit for generating a driving pulse signal according to the divided oscillating signal output from the dividing circuit; a driving coil for driving a unit to be driven, by the driving pulse signal output from the driving-signal generating circuit; and a data storage unit for storing data to be transmitted, is characterized in that a data transmission signal is generated according to the divided oscillating signal output from the dividing circuit and the data stored in the data storage unit, and the data transmission signal is transmitted to an external data transmitting and receiving apparatus through the driving coil between pulses of the driving pulse signal generated by the driving-signal generating circuit at an almost constant interval.

DETAILED DESCRIPTION OF THE PREFERRED EMBODIMENTS

Preferable embodiments of the present invention will be described below by referring to FIG. 1 to FIG. 7.

Figure 1:
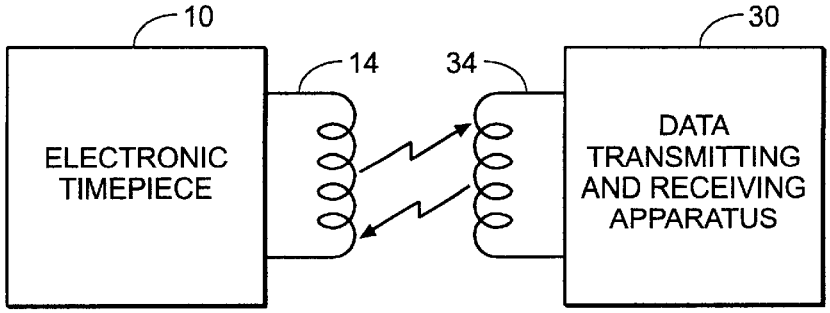
FIG. 1 is a block diagram showing the relationship between an analog electronic timepiece and a data transmitting and receiving apparatus according to an embodiment.

In the present embodiment, as shown in FIG. 1, an analog electronic timepiece 10 serving as an electronic device and a data transmitting and receiving apparatus 30 for receiving data output from the electronic timepiece 10 will be illustrated and described. The present invention is not limited to this combination. The present invention can be applied to a data transmitting and receiving apparatus for achieving communication with an electronic device having a driving coil (corresponding to a hand-movement driving motor coil in an analog electronic timepiece) used for driving a unit to be driven, through the driving motor coil, and for receiving data from the electronic device.

An outlined structure of the analog electronic timepiece will be first described.

Figure 2:
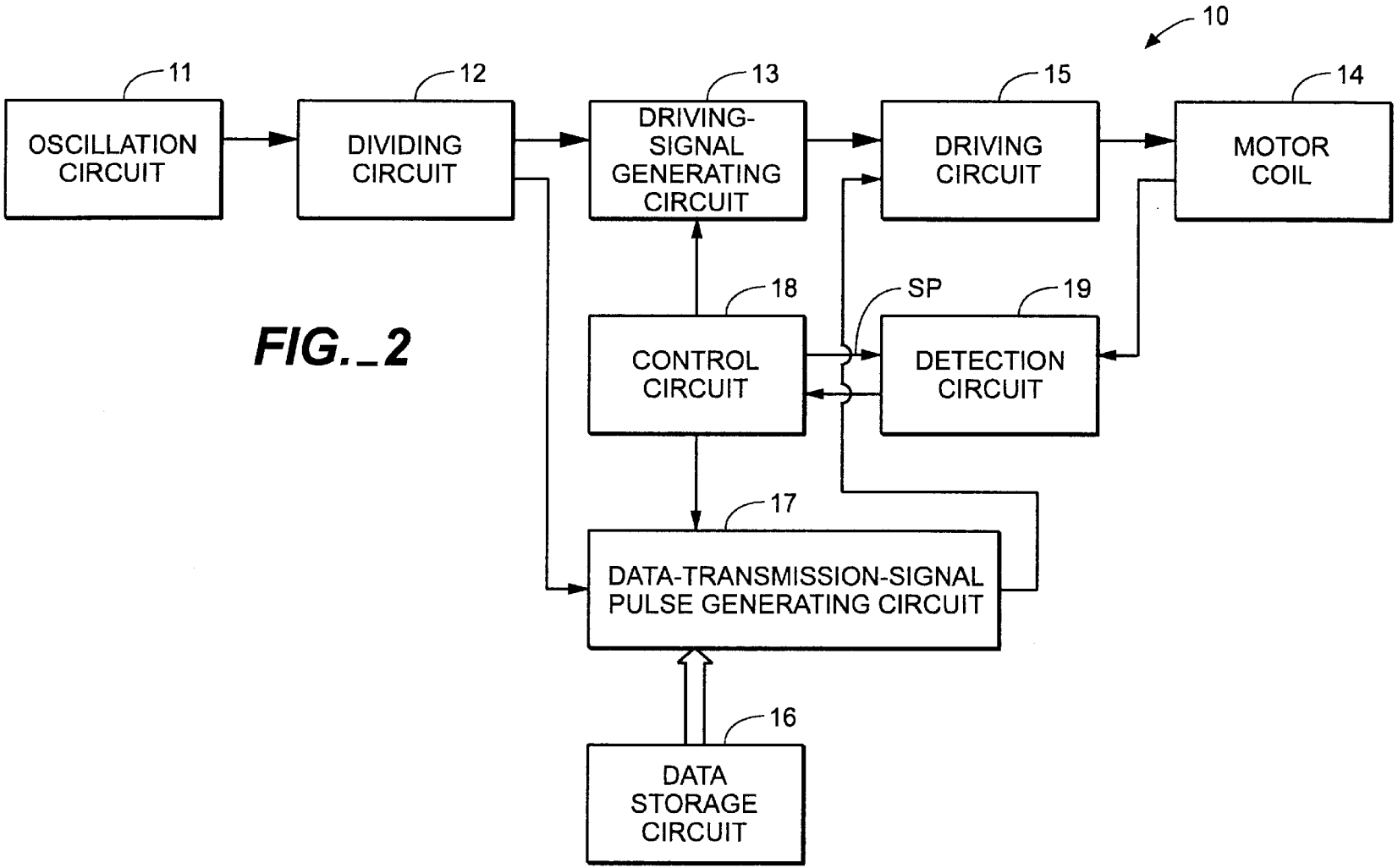
FIG. 2 is a block diagram showing an outlined structure of the analog electronic timepiece according to the embodiment.

FIG. 2 is a block diagram of an outlined structure of the analog electronic timepiece.

The analog electronic timepiece 10 includes an oscillation circuit 11 for generating a reference oscillating signal, a dividing circuit 12 for dividing down the reference oscillating signal and for outputting a divided oscillating signal, a driving-signal generating circuit 13 for generating a driving pulse signal according to the divided oscillating signal, and a driving circuit 15 for outputting the driving pulse signal to a motor coil 14 for driving hands.

The analog electronic timepiece 10 is also provided with a data storage circuit 16, such as an SRAM or a non-volatile memory, including an EEPROM, a flash memory, or a mask ROM, for storing transmission data to be transmitted to the data transmitting and receiving apparatus 30; a data-transmission-signal pulse generating circuit 17 for generating a pulse-shaped data transmission signal according to the divided oscillating signal output from the dividing circuit 12 and the data stored in the data storage circuit 16; and a control circuit 18 for outputting a control signal SP to a detection circuit 19, described later, to control the operation state of the detection circuit 19, and for receiving a detection signal from the detection circuit 19 to control the outputs of the driving-signal generating circuit 13 and the data-transmission-signal pulse generating circuit 17.

The analog electronic timepiece 10 is also provided with the detection circuit 19 whose operation/non-operation state is controlled according to the control signal SP and which outputs a detection signal to the control circuit 18 when it detects a calling signal sent from the data transmitting and receiving apparatus 30 through the motor coil 14 during operation.

The transmission data to be stored in the data storage circuit 16 includes an identification number (hereinafter called an ID) unique to the electronic timepiece 10.

The structures of the driving circuit 15 and the detection circuit 19 in the electronic timepiece 10 will be described next by referring to FIG. 3.

There are shown p-channel field-effect transistors (hereinafter called FETs) P1 and P2, and n-channel FETs N1 and N2. The connection point of the FET P1 and the FET P2 has a voltage of Vdd, is connected to the ground, and is also connected to the non-inverting input terminal of a comparator 22 through a reference-voltage source 21. The connection point of the FET N1 and the FET N2 is connected to a voltage Vss. An output terminal O1, serving as the connection point of the FET P1 and the FET N1, is connected to one end of the motor coil 14, and an output terminal O2, serving as the connection point of the FET P2 and the FET N2, is connected to the other end of the motor coil 14 and to the inverting input terminal of the comparator 21. With these connections, the FETs P1, P2, N1, and N2 form a bridge circuit. The output terminal of the comparator 22 is connected to the control circuit 18.

In a p-channel FET, when a signal having an "L" level is input to the gate, the drain and source are connected to make the FET on. When a signal having an "H" level is input to the gate, the drain and source are disconnected to make the FET off. On the other hand, in an n-channel FET, conversely to the operation of the p-channel FET, when a signal having an "L" level is input to the gate, the drain and source are disconnected to make the FET off. When a signal having an "H" level is input to the gate, the drain and source are connected to make the FET on.

In this circuit, FETs are turned on in the combinations of the FET P1 and the FET N2, and the FET P2 and the FET N1 to make a current flow into the motor coil 14.

Figure 3:
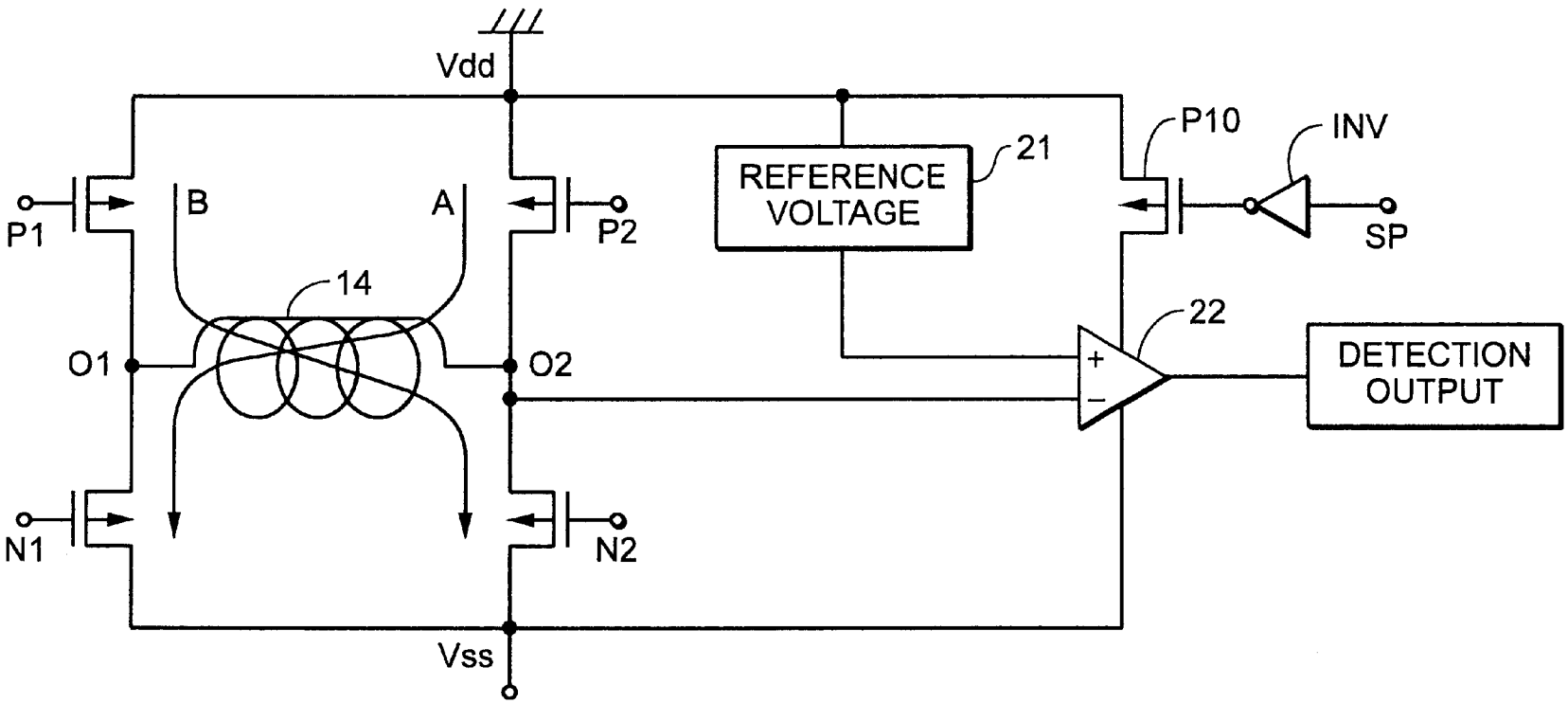
FIG. 3 is a circuit structural view of a driving circuit and a detection circuit.

More specifically, to move the hands, a driving pulse signal is output from the driving-signal generating circuit 13 to set the FET P2 and the FET N1 on to make a current flow in the direction indicated by an arrow A in FIG. 3. To transmit a data transmission signal output from the data-transmission-signal pulse generating circuit 17 to the outside through the motor coil 14, the FET P1 and the FET N2 are turned on to make a current flow in the direction indicated by an arrow B.

It is necessary to reduce the effective power so that a data transmission signal does not drive the motor during data transmission. To this end, the pulse width of the data transmission signal is set narrower than that of the driving pulse signal for driving the motor to move the hands.

The comparator 22 serves as the detection circuit 19 for detecting a calling signal sent from the data transmitting and receiving apparatus 30. The comparator 22 reads an induction voltage induced in the motor coil 14 when the motor coil 14 receives the calling signal, compares the induction voltage with the reference voltage 21, and outputs a detection signal to the control circuit 18 when the calling signal is detected. The detection level of the comparator 22 can be set to any level by changing the reference voltage 21. In this case, in the power-supply path of the detection circuit 19, an inverter INV for inverting the control signal SP and an FET P10 which is on/off-controlled by the control signal SP inverted by the inverter INV are provided in order to block the power to the comparator 22. When the FET P2 is turned off during data receiving and the output terminal O2 enters a high-impedance state, the power is supplied to the comparator 22.

Figure 4:
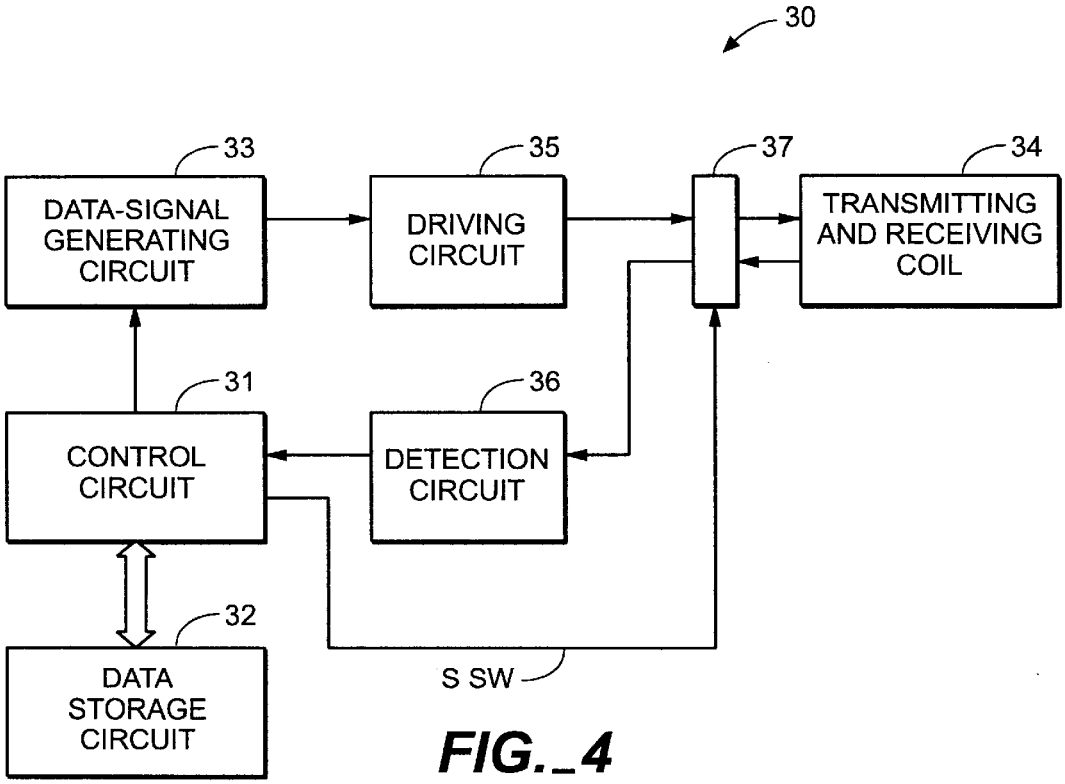
FIG. 4 is a block diagram showing an outlined structure of the data transmitting and receiving apparatus.

An outlined structure of the data transmitting and receiving apparatus will be described below by referring to FIG. 4.

The data transmitting and receiving apparatus 30 includes a control circuit 31 for achieving data transmitting and receiving processing, a data storage circuit 32 connected to the control circuit 31, for storing received data and transmission data for the electronic timepiece 10, a data-signal generating circuit 33 for receiving the received data stored in the data storage circuit 32 and a reference oscillating signal output from an oscillation circuit not shown, and for generating a data signal, a driving circuit 35 for outputting the data signal output from the data-signal generating circuit 33, to a transmitting and receiving coil 34, a detection circuit 36 for detecting a signal received through the transmitting and receiving coil 34, and a switch 37 for switching the transmitting and receiving coil 34 between transmission and receiving according to a switching control signal SSW output from the control circuit 31. As the switch 37, an analog switch or a relay is used.

Figure 5:
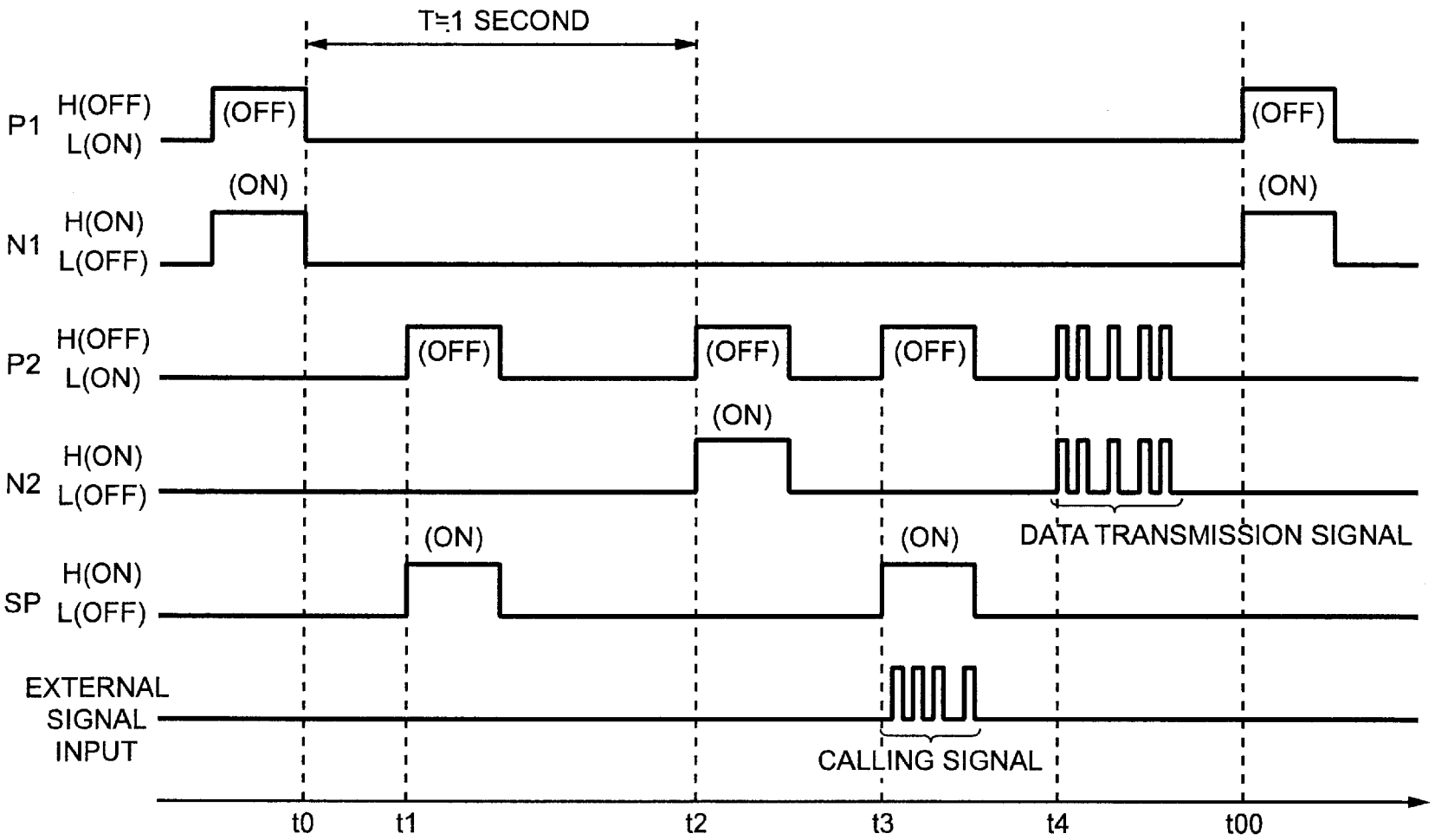
FIG. 5 is a timing chart of the operation of the embodiment.
Figure 6:
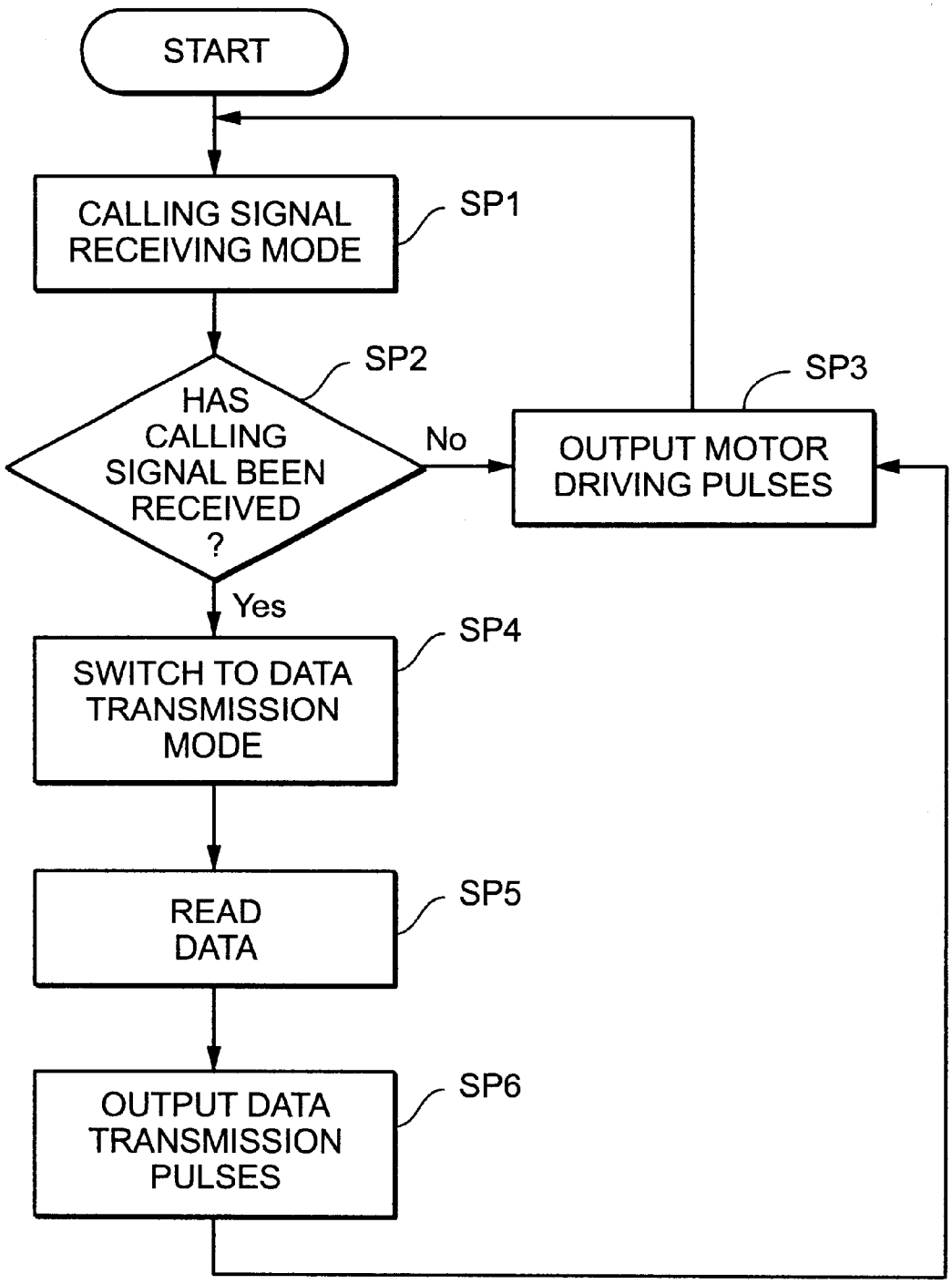
FIG. 6 is a flowchart showing a processing operation in the embodiment.

The operation of the embodiment will be described next by referring to FIG. 5 and FIG. 6.

In a normal operation mode, as described above, when the FET P2 and the FET N1 are turned on, a driving pulse signal for moving the hands is applied to the motor coil 14 at an interval of a predetermined period (about one second) (steps SP1 to SP3). The period between the time t0 when a pulse falls in this driving pulse signal and the time t2 when the next pulse rises is constant and this period T is set to about one second.

When the driving pulse signal is not generated, the FET P1 and the FET P2 are on and the potentials of the output terminals O1 and O2 of the motor coil 14 are fixed to the voltage Vdd.

At the time t1 ($|t0-t1|<T$) when a predetermined time elapses from the time t0 when the pulse falls in the driving pulse signal, the FET P2 is turned off and the output terminal O2 enters an electrically floating state (high-impedance state). At the same time, the FET P10 is turned on and the power is supplied to the comparator 22. The comparator enters an operation state.

The electronic timepiece 10 is switched to a receiving mode, and the motor coil 14 is switched to an external-calling-signal receiving state (step SP1). When a predetermined time elapses after this transition, the electronic timepiece 10 returns to the normal operation mode again.

In the same way, when the FET P2 is turned off at an appropriate time t3, the electronic timepiece 10 is again switched to the receiving mode. This transition to the receiving mode is repeatedly achieved several times (twice in FIG. 5) during the period from the time t0 when the driving pulse signal rises to the time t0 when the next pulse of the driving pulse signal rises.

At the time t3, the electronic timepiece 10 is switched to the receiving mode, and the motor coil 14 enters a state in which a calling signal can be received. At the same time, the FET P10 is turned on, and the power is supplied to the comparator 22. The comparator 22 enters an operation state.

When the data transmitting and receiving apparatus 30 sends a predetermined calling signal to the electronic timepiece 10, the motor coil 14 receives the calling signal and the induced voltage of the motor coil 14 is output to the inverting input terminal of the comparator 22.

The comparator 22 compares the input induced voltage with the reference voltage 21, and the control circuit 18 of the electronic timepiece 10 samples the output signal of the comparator 22 at a predetermined sampling timing specified in advance and determines whether the calling signal has been received (step SP2).

When it is determined in the control circuit 18 that the calling signal has been received, the control circuit 18 switches the mode to a data transmission mode (step SP4), where the FET P1 and the FET N2 are turned on.

In the data transmission mode, transmission data is read from the data storage circuit 16 (step SP5). The control circuit 18 sets the FET P1 and the FET N2 on at the time t4 to make a current flow in a path from the FET P1, through the motor coil 14 to the FET N2 (indicated by the arrow B in FIG. 3).

The electronic timepiece 10 transmits a data transmission signal having a predetermined frequency higher than the driving pulse signal to the external data transmitting and receiving apparatus 30 through the motor coil 14 (step SP6).

A receiving operation achieved in the data transmitting and receiving apparatus 30 will be described below by referring to FIG. 7.

Figure 7:
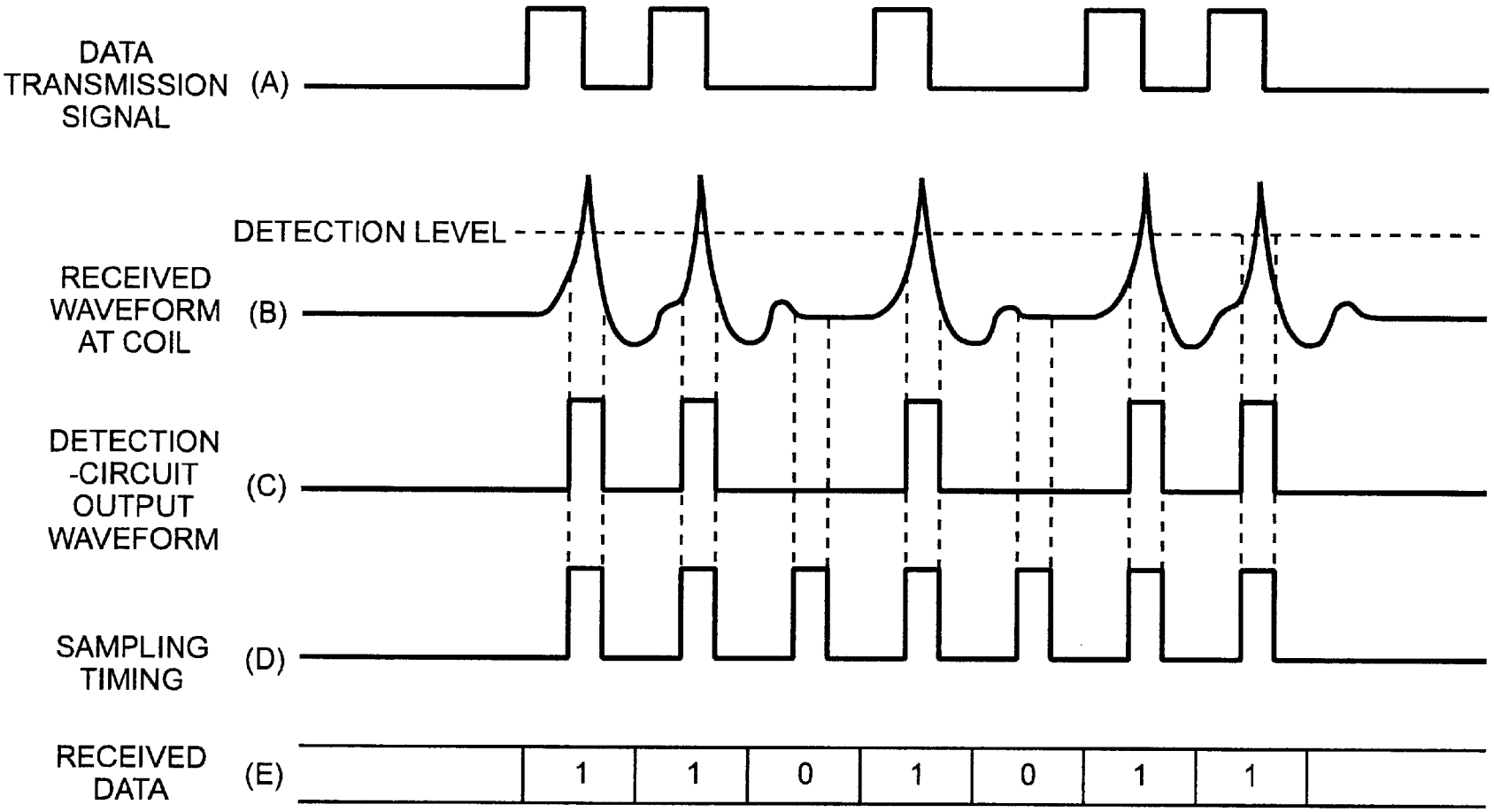
FIG. 7 is a view showing operations of the data transmitting and receiving apparatus according to the embodiment.

When the electronic timepiece 10 is to transmit a data transmission signal shown in FIG. 7(*a*), the transmitting and receiving coil 34 of the data transmitting and receiving apparatus 30 receives a waveform shown in FIG. 7(*b*).

The detection circuit 36 compares a predetermined detection level with the level of the received waveform, shapes the waveform, and outputs a waveform shown in FIG. 7(*c*) to the control circuit 31.

The control signal 31 samples the output waveform of the detection circuit 36 at the sampling timing corresponding to a predetermined sampling-timing signal shown in FIG. 7(*d*) to obtain received data ("1101011").

When the electronic timepiece 10 finishes data transmission, the procedure returns to the step SP3, and the electronic timepiece 10 is automatically returned to the normal operation mode, in which the driving pulse signal is output to the motor coil 14 at a constant interval T.

As described above, according to the present embodiment, transmission data stored in the data storage circuit 16 of the analog electronic timepiece is sent through the motor coil 14 and the driving circuit 15 for hand movement when a calling signal is received from the data transmitting and receiving apparatus 30. Therefore, without additionally providing a new antenna, the data stored in the data storage circuit of the electronic timepiece is sent to the outside.

Since data is transmitted and received between the output timing of the motor driving pulses applied at an interval of a predetermined time, data transmission and receiving is implemented without stopping the hand-movement operation of the timepiece.

Consequently, a time recovery circuit and others conventionally provided for an electronic timepiece can be omitted and data transmission is implemented by a simple structure. In addition, it is not necessary to install a new antenna for data transmission, and the current structure of the electronic timepiece 10 can be used.

When transmission data stored in the data storage circuit 16 is set to the ID unique to the electronic timepiece 10, the ID number assigned to the electronic timepiece 10 can be easily identified from the outside without taking the electronic timepiece 10 apart and can be used for product management during a distribution stage, and it can be easily determined whether the electronic timepiece is counterfeit.

When transmission data is set to individual data, such as the commuting zone or the valid period of a commuter pass, if the data transmitting and receiving apparatus 30 is installed at a gate and is provided with determination means, the user does not need to carry the commuter pass separately from the timepiece nor take out the commuter pass every time when the user passes through the gate.

When individual data for a lift ticket in a ski resort is used, the same advantages are obtained.

Transmission data can be the operation-state information of an electronic timepiece. In this case, when the counter-value information of various internal counters or operation-load information is transmitted, for example, the transmitted data helps the user to understand the operation state of the electronic timepiece in real time without opening the case cover of the device externally.

Figure 8:
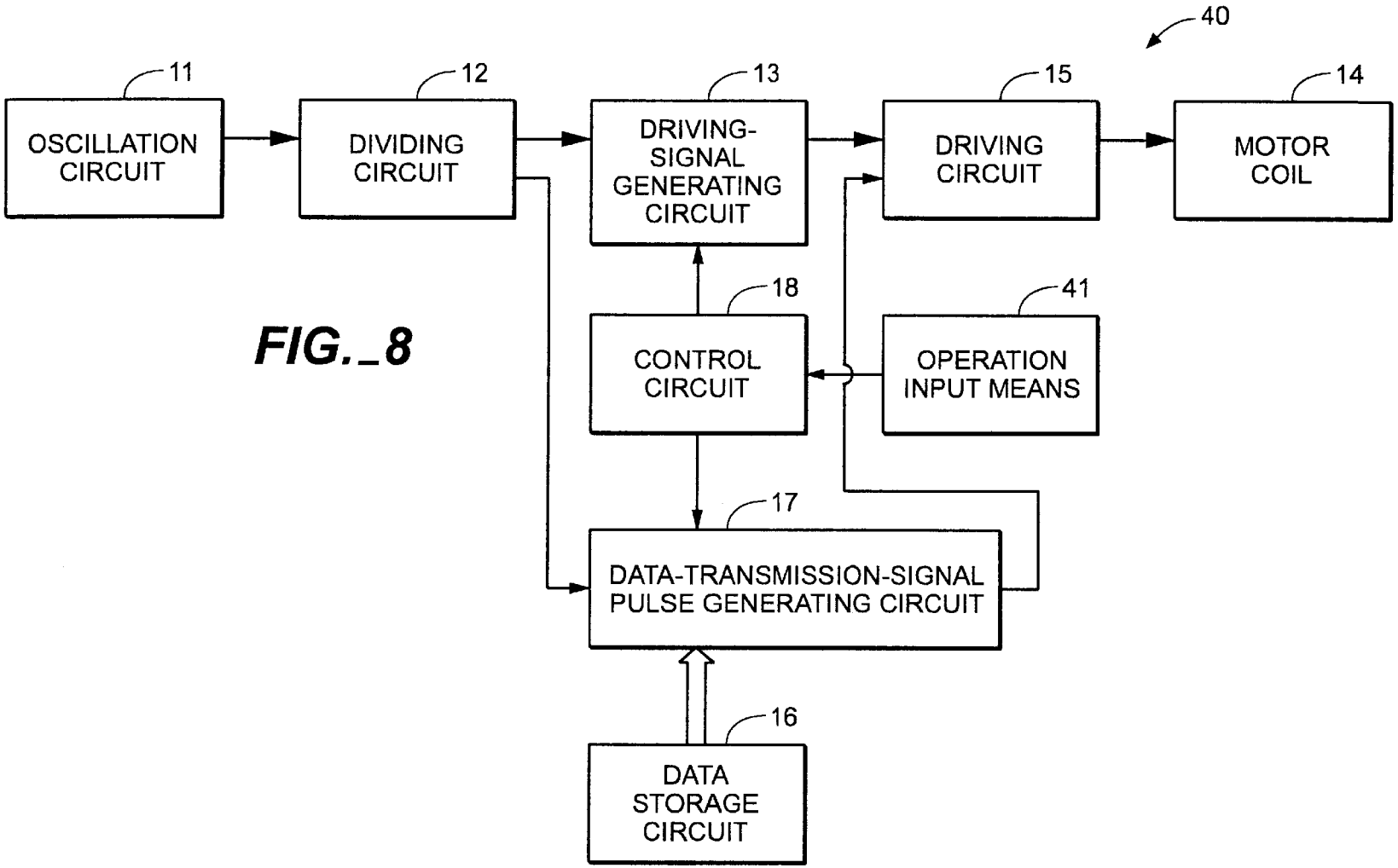
FIG. 8 is a block diagram showing an outlined structure of an analog electronic timepiece according to a first modified embodiment.

A first modified embodiment will be described below by referring to FIG. 8.

In the first modified embodiment, the crown of an analog electronic timepiece 40 serves as operation input means 41.

In this electronic timepiece 40, the user operates the crown (operation input means 41) to transmit data without receiving an external calling signal. In this case, the structure of the detection circuit 19 can be omitted in the electronic timepiece 10 of the above embodiment. However, a switch (not shown) for the crown is required.

In the description of the above embodiment, the comparator 22 serves as calling-signal detecting means. The present invention is not limited to this configuration. An inverter circuit can serve as the calling-signal detecting means. In this case, the circuit structure becomes simple and current is reduced, but the threshold of a detection voltage is almost (Vdd−Vss)/2 and a detection-level setting is fixed.

In the above description, data is transmitted only once. It is of course possible that data is transmitted several times to increase reliability.

In the description of the above embodiment, the mode is automatically returned to the normal operation mode after data transmission. The present invention is not limited to this way of changing the mode. Mode changes may be set such that the transmission mode lasts once the mode is changed to the transmission mode, the output of the driving pulse signal to the driving circuit 15 is stopped, and data transmission continues. In this case, a button or the crown needs to be set so as to be externally operated to return to the normal operation mode.

In the description of the above embodiment, the detection circuit 19 of the electronic timepiece 10 receives a signal (detects a signal) only when the output terminal O2 is in a high-impedance state. It is also possible to configure the electronic timepiece 10 such that signal receiving (signal detection) is achieved when the output terminals O1 and O2 are alternately switched to a high-impedance state.

In the description of the above embodiment, an analog timepiece has been taken as an example. The present invention is not limited to analog timepieces. The present invention can also be applied, for example, to various electronic devices having a driving coil, such as electrically powered toothbrushes and electrically powered shavers.

In the other first mode of the present invention, in a data transmission method for an electronic timepiece provided with an oscillation circuit for generating a reference oscillating signal; a dividing circuit for dividing the reference oscillating signal generated by the oscillation circuit and for outputting a divided oscillating signal; a driving-signal generating circuit for generating a driving pulse signal according to the divided oscillating signal output from the dividing circuit; a driving coil for driving a unit to be driven, by the driving pulse signal output from the driving-signal generating circuit; and a data storage unit for storing data to be transmitted, an operation input step in which the user inputs an instruction is provided, a data transmission signal is generated according to the divided oscillating signal output from the dividing circuit and the data stored in the data storage unit when the instruction is input, and the data transmission signal is transmitted to an external data transmitting and receiving apparatus through the driving coil between pulses of the driving pulse signal generated by the driving-signal generating circuit at an almost constant interval.

In the other second mode of the present invention, in a data transmission method for an electronic timepiece provided with an oscillation circuit for generating a reference oscillating signal; a dividing circuit for dividing the reference oscillating signal generated by the oscillation circuit and for outputting a divided oscillating signal; a driving-signal generating circuit for generating a driving pulse signal according to the divided oscillating signal output from the dividing circuit; a driving coil for driving a unit to be driven, by the driving pulse signal output from the driving-signal generating circuit; and a data storage unit for storing data to be transmitted, a calling-signal detecting step of detecting a calling signal output from an external data transmitting and receiving apparatus, through the driving coil, is provided, a data transmission signal is generated according to the divided oscillating signal output from the dividing circuit and the data stored in the data storage unit when the calling signal is detected, and the data transmission signal is transmitted to the external data transmitting and receiving apparatus through the driving coil between pulses of the driving pulse signal generated by the driving-signal generating circuit at an almost constant interval.

What is claimed is:

1. An electronic timepiece comprising:

an oscillation circuit for generating a reference oscillating signal;

a dividing circuit for dividing the reference oscillating signal generated by said oscillation circuit and for outputting a divided oscillating signal;

a driving-signal generating circuit for generating a driving pulse signal according to the divided oscillating signal output from said dividing circuit;

a driving coil for driving a unit to be driven by the driving pulse signal output from said driving-signal generating circuit;

a data storage device for storing data to be transmitted; and a transmitter including a data-transmission-signal pulse generating circuit for generating a data transmission signal according to the divided oscillating signal output from the dividing circuit and the data stored in said data storage means, for transmitting the data transmission signal to an external data transmitting and receiving apparatus through said driving coil.

2. An electronic timepiece according to claim 1, characterized in that said driving-signal generating circuit comprises a first switching element connected between one end of said driving coil and a first power line, a second switching element connected between the other end of said driving coil and the first power line, a third switching element connected between the one end of said driving coil and a second power line, and a fourth switching element connected between the other end of said driving coil and the second power line, and the first switching element and the fourth switching element are turned on at the same time, or the second switching element and the third switching element are turned on at the same time, to make a current flow to transmit the data transmission signal.

3. An electronic timepiece according to claim 1, characterized in that said transmitter transmits the data transmission signal to the external data transmitting and receiving apparatus through said driving coil between pulses of the driving pulse signal generated by said driving-signal generating circuit at essentially a constant interval.

4. An electronic timepiece according to claim 3, characterized in that the data transmission signal is synchronized with the driving pulse signal, and is transmitted to the external data transmitting and receiving apparatus at a predetermined time after the driving pulse signal is output.

5. An electronic timepiece according to claim 1, characterized by further comprising an operation input device with which the user inputs an instruction, and characterized in that said transmitter transmits data to the external data transmitting and receiving apparatus when a predetermined instruction is input through said operation input device.

6. An electronic timepiece according to claim 5, characterized in that said transmitter switches the mode to a data transmission mode and transmits data to the external data transmitting and receiving apparatus when the predetermined instruction is input through said operation input device, and said transmitter releases the data transmission mode to stop the data transmission when a predetermined instruction corresponding to stopping the data transmission is input through said operation input device during the data transmission mode.

7. An electronic timepiece according to claim 1, characterized by further comprising a calling-signal detecting device for detecting a calling signal output from the external data transmitting and receiving apparatus, through said driving coil, and characterized in that said transmitter transmits data to the external data transmitting and receiving apparatus when said calling-signal detecting device detects the calling signal.

8. An electronic timepiece according to claim 1, characterized in that the unit to be driven is an analog timepiece unit which achieves a timepiece operation by using analog hands.

9. An electronic timepiece according to claim 1, characterized in that the data stored in said data storage device is operation information data of said electronic timepiece.

10. An electronic timepiece according to claim 1, characterized in that the data stored in said data storage device is either identification data unique to the unit to be driven or individual data of the user.

11. A data transmission method for an electronic timepiece having an oscillation circuit for generating a reference oscillating signal; a dividing circuit for dividing the reference oscillating signal generated by the oscillation circuit and for outputting a divided oscillating signal; a driving-signal generating circuit for generating a driving pulse signal according to the divided oscillating signal output from the dividing circuit; a driving coil for driving a unit to be driven by the driving pulse signal output from the driving-signal generating circuit; and a data storage unit for storing data to be transmitted, characterized in that a data transmission signal is generated according to the divided oscillating signal output from the dividing circuit and the data stored in the data storage unit, and the data transmission signal is transmitted to an external data transmitting and receiving apparatus through the driving coil between pulses of the driving pulse signal generated by the driving-signal generating circuit at essentially a constant interval.

* * * * *